United States Patent [19]

Saint Gerand

[11] Patent Number: 4,895,263

[45] Date of Patent: Jan. 23, 1990

[54] FOLDABLE MACHINE FOR HANDLING AND LIFTING LOADS

[75] Inventor: Jean C. Saint Gerand, Loire, France

[73] Assignee: Potain, Societe Anonyme, Rhone, France

[21] Appl. No.: 111,724

[22] Filed: Oct. 22, 1987

[30] Foreign Application Priority Data

Oct. 27, 1986 [FR] France ..... 86 15095

[51] Int. Cl.[4] ..... B66C 23/34

[52] U.S. Cl. ..... 212/185; 212/187; 212/188; 212/261

[58] Field of Search ..... 212/182, 183, 184, 185, 212/186, 187, 188, 261, 262

[56] References Cited

U.S. PATENT DOCUMENTS

| | | | |
|---|---|---|---|
| 2,689,053 | 9/1954 | Olson | 212/261 |
| 3,084,806 | 4/1963 | Staples | 212/188 |
| 3,154,198 | 10/1964 | Balogh | 212/187 |
| 3,235,097 | 2/1966 | Ohman | 212/188 |
| 3,451,427 | 6/1969 | Dellinger | 212/261 |
| 3,596,772 | 8/1971 | Pingon | 212/185 |
| 4,383,616 | 5/1983 | Sterner et al. | 212/182 |
| 4,660,729 | 4/1987 | Carbert | 212/261 |
| 4,700,851 | 10/1987 | Reeve | 212/188 |

FOREIGN PATENT DOCUMENTS

| | | | |
|---|---|---|---|
| 1257390 | 12/1967 | Fed. Rep. of Germany . | |
| 1431909 | 6/1969 | Fed. Rep. of Germany | 212/183 |
| 1531150 | 12/1969 | Fed. Rep. of Germany . | |
| 1956920 | 3/1971 | Fed. Rep. of Germany . | |
| 2546496 | 11/1984 | France . | |
| 2142902 | 1/1985 | United Kingdom | 212/183 |

*Primary Examiner*—Joseph F. Peters, Jr.
*Assistant Examiner*—Thomas J. Brahan
*Attorney, Agent, or Firm*—Browdy and Neimark

[57] ABSTRACT

The machine comprises, above a rotating frame, a mast which is foldable into two elements, a jib pivoted at the top of mast and a jib head member for the placing of loads, pivoted at the end of the jib. Straightening and holding in working position is assured by a unit comprising at least one counterbrace, a tie connected to a foot of the jib head member, a set of posts, a back holding cable, and a first double-acting jack associated with a system of connecting rods pivoted on the mast elements. Another double-acting jack connects the jib to the foot of the jib head member to make the machine work at different radii. The machine can be used for holding, lifting and placing loads on small-building construction sites.

8 Claims, 6 Drawing Sheets

FOLDABLE MACHINE FOR HANDLING AND LIFTING LOADS

BACKGROUND OF THE INVENTION

1. Field of the Invention

This invention relates to a foldable machine intended to be used for various tasks such as the handling, lifting and placing of loads, particularly at the construction sites of small buildings such as small apartment houses and small office buildings.

2. The Prior Art

It was known to assure the handling, lifting and placing of loads at construction sites by using a mobile crane equipped with a retractable telescopic jib. However, a number of drawbacks attend the use of the mobile crane because of its configuration. The ground space required is considerable, which calls for a sufficiently extended clearance area. This space can be hard to find in some cases. Additionally, the height under the hook necessary to reach the farthest points of the building under construction is clearly greater than the useful height for the construction site.

It is also known to use a standard tower crane with an automated assembly, which is equipped with a flexible or telescopic mast and a placing or derricking jib at the top of the mast. The jib is either telescopic or constructed of two or more elements joined to one another. The presently used embodiments of this type exhibit the following drawbacks. The clearance area necessary for unfolding the crane, particularly its jib, is considerable. Additionally, the unfolding devices generally comprise metal cables which follow more or less complicated paths and require considerable assembly preparation time and manual intervention. Further, automation of the work of the crane is difficult to achieve.

The invention aims at reducing the drawbacks presented by the two preceding solutions. In particular, the invention is designed to reduce the clearance area necessary for putting the machine into operation, to match the height under the hook with the needs of the site, to allow rapid placement without manual intervention and thus to improve the safety and profitability, and finally to permit automation of the work of the machine.

SUMMARY OF THE INVENTION

For this purpose, the invention has as its object a handling and lifting machine which includes a mast foldable into at least two elements, a jib pivoted at the top of the mast which is equipped with at least one counterbrace for straightening and holding the mast in a raised work position and a unit for holding the jib consisting of a tie, at least one post and a back holding cable connected to the back part of a revolving chassis or turret. The machine comprises, in combination, a double-acting jack connecting a lower mast element to a common joint of a system of connecting rods whose ends are pivoted respectively on the base of an upper mast element and at the top of the lower mast element, a jib head member pivoted on the end of the jib, the jib head member carrying means for suspension of a load, and beyond its pivot pin on the jib, a foot having a connection with the tie of the holding unit, and another double-acting jack connecting the jib to a joint located on the foot of the jib head member and acting as a lever support point for the jib head member.

The handling and lifting machine therefore comprises a structure made up mainly of a revolving chassis or turret, a mast foldable into two elements, a jib pivoted at the top of the mast and a jib head member pivoted at the end of the jib. The jib head member assures the placement of the loads. The machine is further equipped with a device for unfolding the mast and a device for deploying the jib or jib head member.

The double-acting jack associated with the connecting rod system has the role of actuating the unfolding of the mast, while the counterbrace or counterbraces assure the straightening and alignment of the two elements of the mast to a position that can be approximately vertical. During the erection or unfolding phase, the jib head member remains folded under the jib so that the space requirement of the machine during unfolding does not exceed the ground space requirement of the machine in its transport position. At the end of the unfolding phase, the mast and jib are in an approximately vertical position, while the jib head member is angularly slightly separated from the jib, so that the machine is in a minimum work position with a minimum radius. Folding of the machine can be performed in a completely automatic manner.

During work, placement of the load, which is suspended from a hook under the tip of the jib head member, is assured by the functioning of the double-acting jack connecting the jib to the foot of the jib head member. The configuration of the machine is such that the placement of the load is performed practically on a horizontal plane, like on a tower crane with a placing jib. The load placement function can also be automated.

In a preferred embodiment of the invention, the connection between the foot of the jib head member and the tie of the holding unit consists of a connecting rod pivoted at one end on the foot of the jib head member and connected at another end to the tie, and a jack pivoted on the foot of the jib head member and resting on a joint carried by the connecting rod. Operation of this additional jack makes it possible to increase, if necessary, the height of the hook under the machine, by straightening the jib. This function is also capable of being automated.

BRIEF DESCRIPTION OF THE DRAWINGS

In any case, the invention will be better understood, and other characteristics will be brought out, with the following description, with reference to the accompanying drawings, by way of nonlimiting example, to an embodiment of the foldable machine for handling and lifting loads, in which.

DETAILED DESCRIPTION OF THE PREFERRED EMBODIMENT

Figure 2:
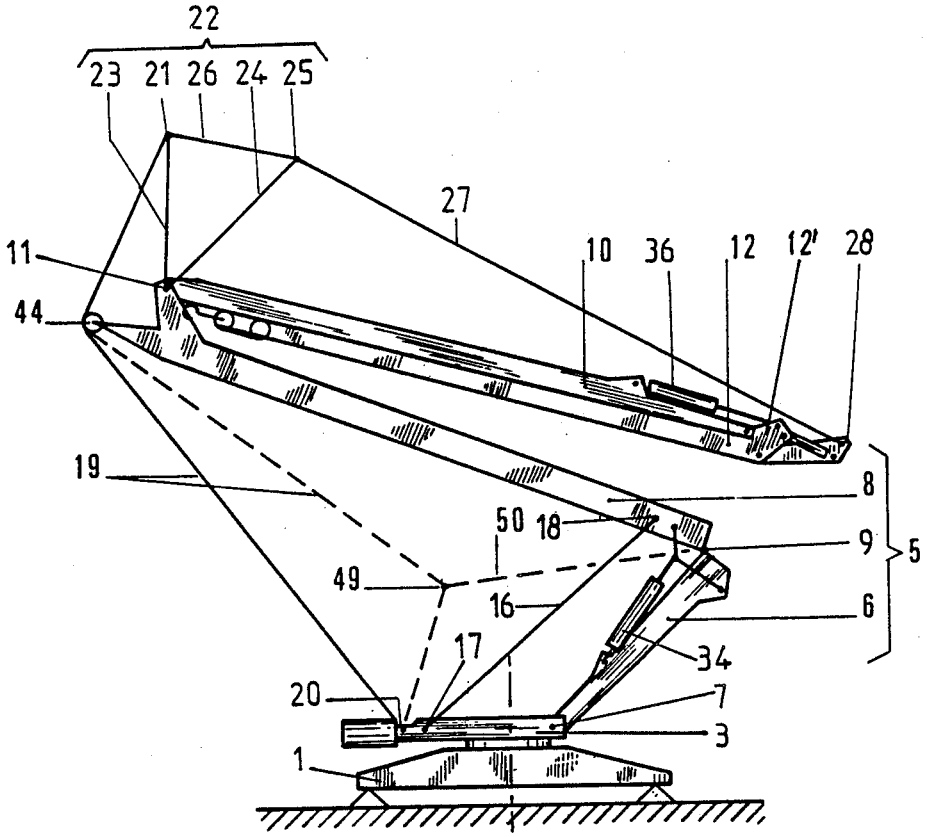
FIGS. 2 and 3 illustrate two successive phases of unfolding the machine.

The handling and lifting machine represented in the drawings comprises a carrying frame 1, which is able to be self-propelled, that is, it is equipped with means, not shown here, for providing movement of the machine on the ground. Carrying frame 1 is provided with an orientation device 2, for orienting a rotating frame or turret 3 around a vertical axis. Rotating frame 3 carries a counterweight 4 at a back portion thereof; it also supports a hydraulic lifting winch and an operator's station, which are not shown.

The machine is provided with foldable mast 5, made up of lower mast element 6 whose base is mounted to pivot around horizontal pin 7 on the front part of rotating frame or turret 3, and upper mast element 8 whose base is pivoted around horizontal pivot pin 9 at the top of lower mast element 6. Jib 10 is pivoted around horizontal pivot pin 11 at the top of upper mast element 8. Jib head member 12 is pivoted around horizontal pivot pin 13 at the end of jib 10. The tip of jib head member 12 carries tackle 14 and lifting hook 15, for the suspension of the load. Opposite its tip, jib head member 12 comprises foot 12' which extends beyond the pivot pin 13 connecting jib 10 and jib head member 12.

Figure 1:
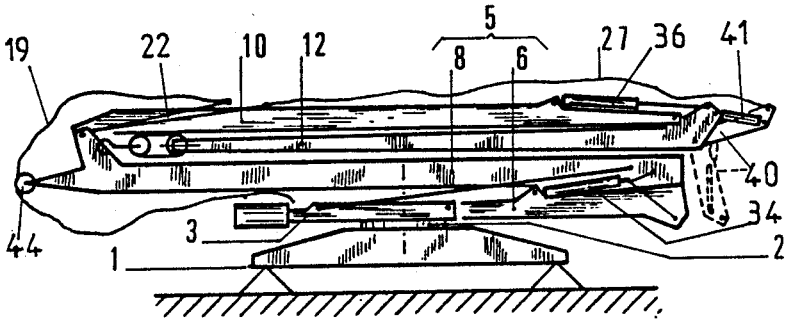
FIG. 1 is an elevation view of a handling and lifting machine according to the invention, folded for transporting.

In the transport position, shown in FIG. 1, mast 5 is folded horizontally above rotating frame 3. The two elements 6 and 8 of mast 5 are folded against one another. Jib head member 12 is folded under jib 10, and the unit formed by jib 10 and jib head member 12 is folded horizontally against mast 5.

To assure unfolding and performance in service, the machine is equipped with two straightening counterbraces 16 placed symmetrically on both sides of mast 5. Each counterbrace 16 is connected at one end by joint 17 to the back part of rotating frame or turret 3, and connected at its other end by another joint 18 to the lower part of upper mast element 8. Back holding cable 19, which has a fixed length, is connected by one end at 20 to the back part of rotation frame 3, and by its other end to a top 21 of a set of posts 22. Set 22 consists of two rigid bars or posts 23 and 24, having cooperating ends which are pivoted around pivot pin 11 at the top of upper mast element 8. The other ends 21 and 25 of posts 23 and 24 form the tops of set 22 and are connected together by coupling element 26. Tie 27, preferably consisting of a cable, connects top 25 of the set of posts 22 to joint 28 located on an extension of foot 12' of jib head member 12.

For erection, the machine is also equipped, at pivot pin 9 between the two mast elements 6 and 8, with a system of connecting rods made up of two connecting rods 29 and 30 in the particular embodiment represented. The two connecting rods 29 and 30 are joined together at one of their ends along horizontal pin 31. First connecting rod 29 is pivoted at its other end by pin 32 at the base of upper mast element 8. Second connecting rod 30 is pivoted at its other end by pin 33 at the top of the lower mast element 6. Double-acting jack 34 connects pivot pin 31, common to the two connecting rods 29 and 30, to an intermediate point of lower mast element 6, the pivot pin of jack 34 on lower mast element 6 being indicated as 35.

For working, the machine is also equipped with double-acting jack 36, located at the joint at pivot pin 13 between jig head member 12 and jib 10. Jack 36 is pivoted around pin 37 on jib 10, near the end of the latter, and is also pivoted around pin 38 on foot 12' of jib head member 12, the latter joint acting as a lever support point for jib head member 12.

Figure 3:
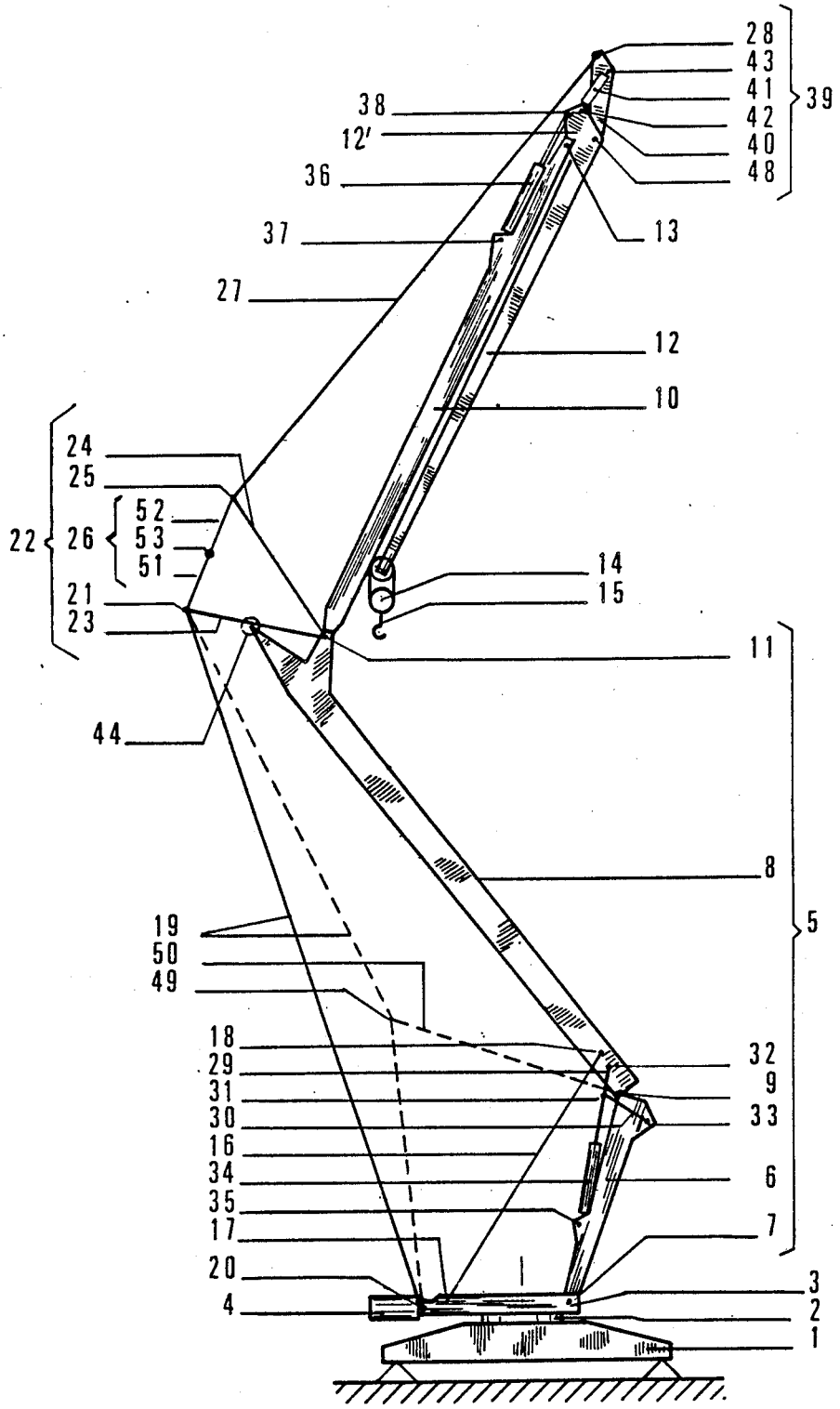
Figure 4:
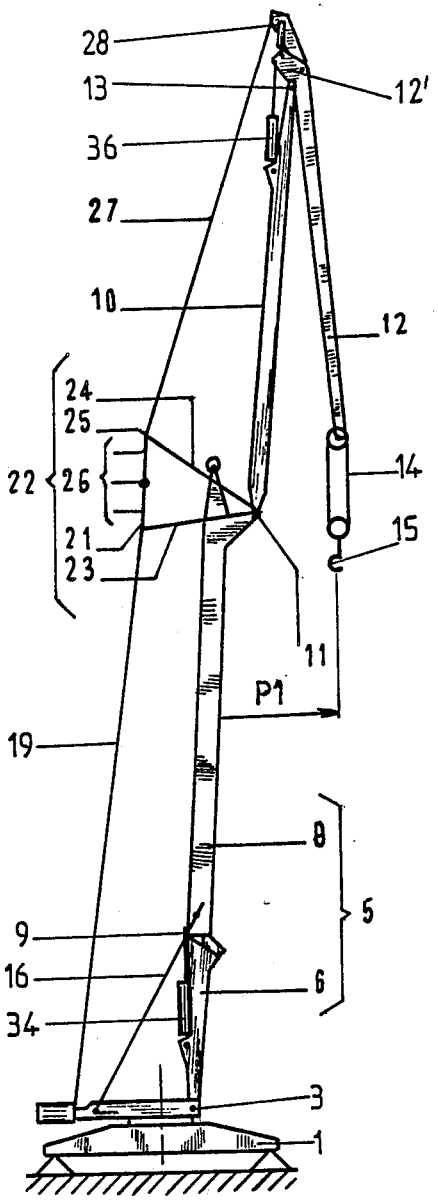
FIG. 4 shows the machine according to the invention at the end of assembly.

The functioning during assembly, illustrated by FIGS. 2 to 4, is explained as follows.

When jack 34 is operated in the rod extension direction, connecting rods 29 and 30 are subjected to compression forces. The thrust thus exerted and transmitted to the two elements 6 and 8 of foldable mast 5 tends to open the angle formed by these two mast elements 6 and 8.

The end of each counterbrace 16, pivoted at 18 on upper mast element 8, describes a circle around joint 17 on rotating frame 3. Mast 5 is unfolded as it is straightened, passing through two intermediate positions shown in FIGS. 2 and 3, until the two mast elements 6 and 8 are aligned as shown in FIG. 4.

During this phase, the holding unit, consisting of back cable 19, the set of posts 22 and tie 27, is pulled taut and the unit formed by jib 10 and jib head member 12 pivots around horizontal pin 11, while being straightened. Jib head member 12 remains folded against jib 10, as shown in FIGS. 2 and 3, so that the space requirements of the machine during unfolding practically do not exceed the ground space requirements of this machine in the transport position (see also FIG. 1).

Upper mast element 8 advantageously comprises, at the top thereof, roller 44, having a horizontal axis, on which back holding cable 19 passes at the beginning of unfolding, as shown in FIG. 2.

At the end of the unfolding, as shown in FIG. 4, mast 5 and jib 10 are in an approximately vertical position. Jib head member 12 is slightly separated angularly from jib 10, by causing a slight reentry of the rod of jack 36, which places tackle 14 and lifting hook 15 at a certain minimum radius.

The machine is thus ready for use and functions during work as follows.

Figure 5:
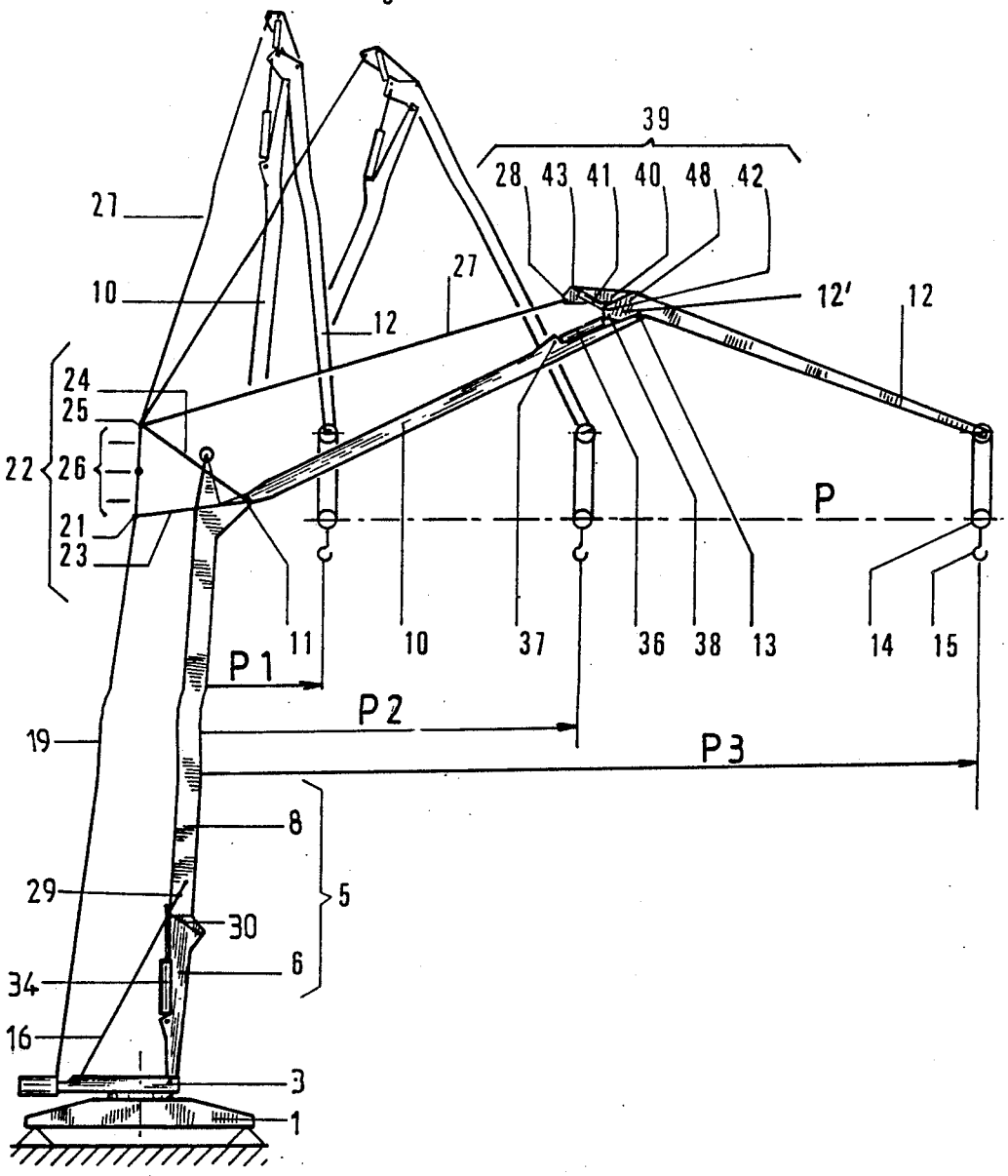
FIG. 5 illustrates several positions occupied during the load placement work.

By operating jack 36 so that its rod reenters cylinder of the jack, a force is exerted on joint 38 at the foot of jib head member 12' which makes jib 12 pivot around its pivot pin 13 on jib 10, while the unit formed by jib 10 and jib head member 12 pivots around joint 11 of jib 10 at the top of mast 5. Tops 11, 13, 28 and 25 of the deformable trapezoid defined by jib 10, foot 12' of jib head member 12, tie 27 and post 24 are selected so that the combination of the two above-mentioned movements causes movement of the tip of jib head member 12 carrying tackle 14 and hook 15, over a surface P lying in approximately horizontal plane, as shown in FIG. 5. The machine can thus be brought from its working position having a minimum radius P1 to a working position having a maximum radius P3, passing through all intermediate positions, like the position represented corresponding to a certain intermediate radius P2. Therefore, horizontal placement of the load suspended from lifting hook 15 is obtained like a standard tower crane with a placing jib, without the need for a placing carriage.

Figure 6:
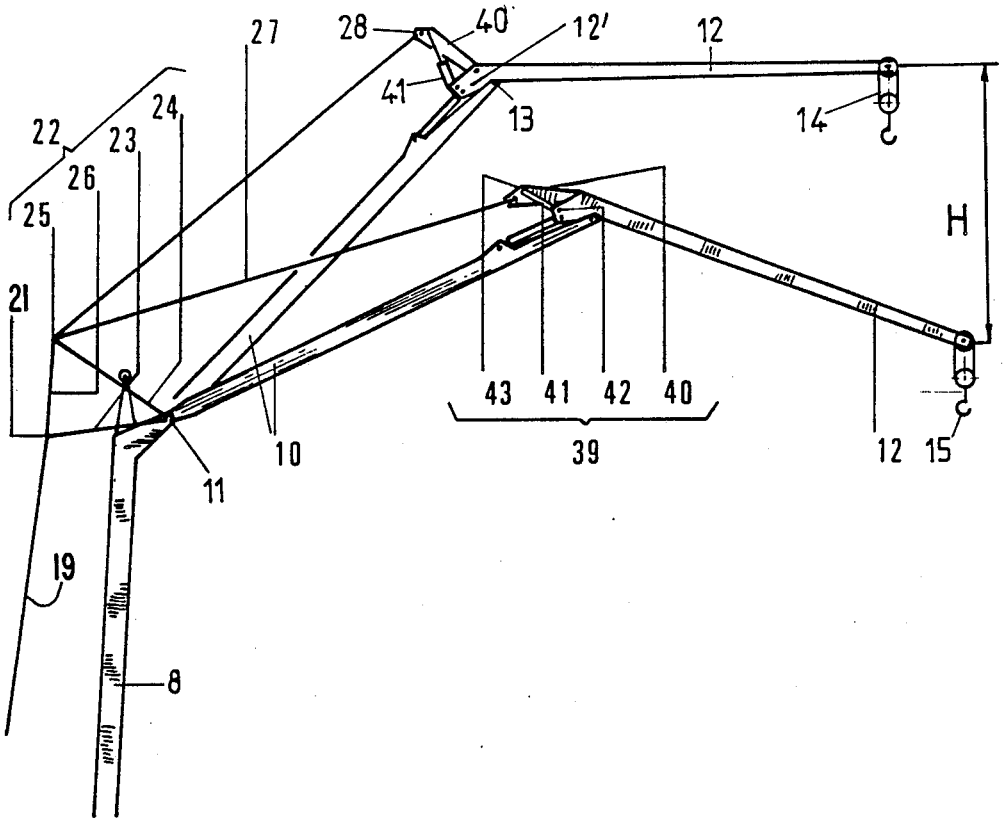
FIG. 6 is a partial view of the machine, showing another possibility of use.
Figure 7:
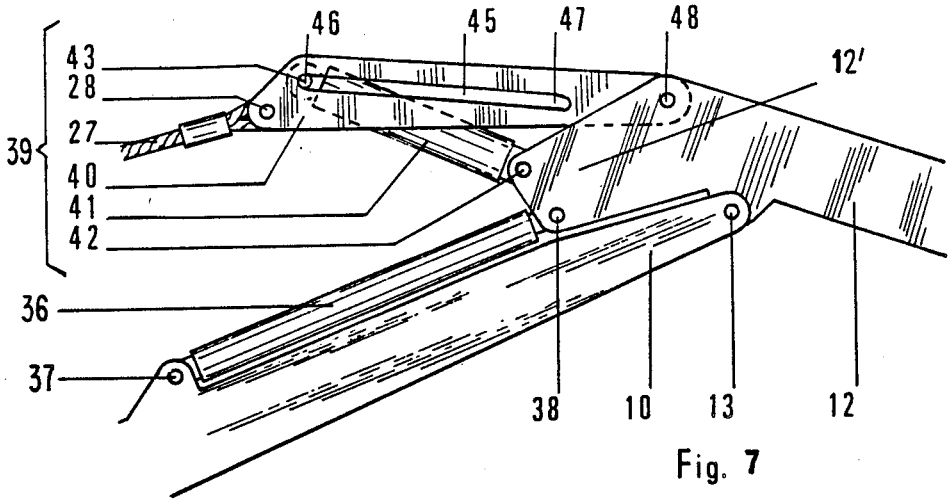
FIGS. 7 and 8 represent, on an enlarged scale, the detail of the connection between the tie and jib head member, in two different positions.
Figure 8:
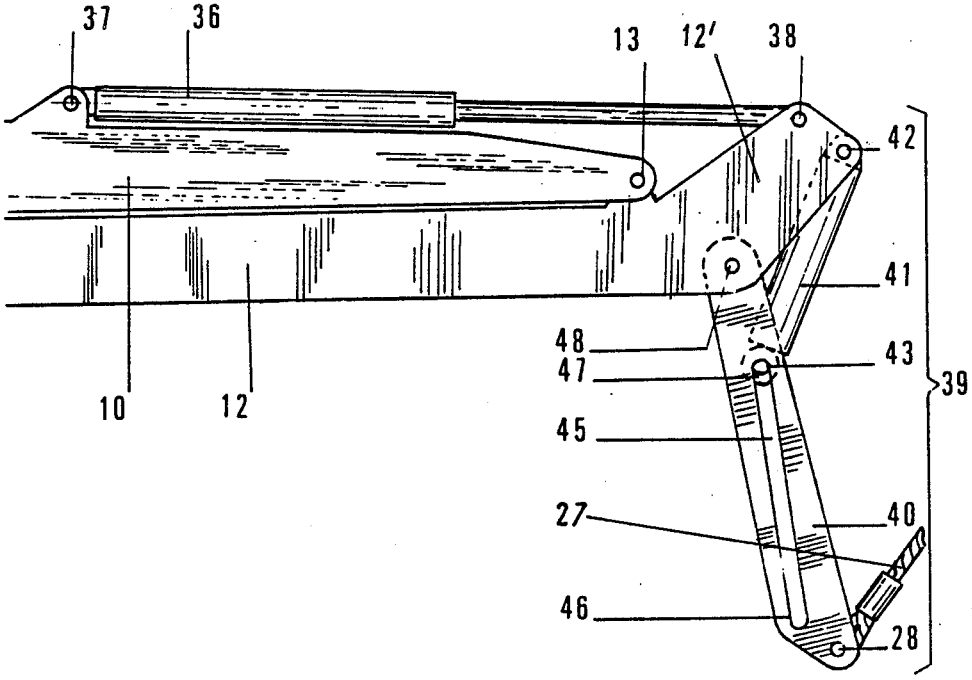

In a preferred embodiment of the invention, shown in the drawings and more particularly in FIGS. 7 and 8, connection 39 is provided between tie 27 and jib head member 12. Connection 39 comprises connecting rod 40 and additional jack 41. Connecting rod 40 is pivoted by one end around pin 48 on foot 12' of jib head member 12, tie 27 being connected by joint 28 to the other end of connecting rod 40. Jack 41 is pivoted, at one end, around pin 42, at foot 12' of jib head member 12 and, at the other end, jack 41 rests on joint 43 carried by connecting rod 40. In the operation during the course of the work of the machine described above, the rod of jack 41 is brought in completely, and jack 41 serves as a stop for connecting rod 40 which then is positioned as close as possible to jib 10. By causing the rod of jack 41 to extend, connecting rod 40 is separated from jib 10 and thus the trapezoid defined by jib 10, foot 12' of jib head member 12, tie 27 and post 24 is modified, so that jib 10 straightens with jib head member 12, as shown in FIG. 6. The tip of jib head member 12 is thus raised a certain height H, which makes it possible to increase the height of the machine hook correspondingly.

In the particular embodiment described, and referring again to FIGS. 7 and 8, connecting rod 40 comprises longitudinal hole 45, through which support pin 43 of jack 41 passes. Pin 43 is movable between one end 46 of hole 45 and the other end 47 of the hole. In the working position, as shown in FIG. 7, support pin 43 of jack 41 strikes end 46 of connecting rod 40 located on the side of joint 28 of tie 27. In transport position, as shown in FIG. 8 and also by the dotted line of FIG. 1, support pin 43 of jack 41 is moved toward the other end 47 of connecting rod 40. This causes connecting rod 40 to be bent to an approximately vertical position. Thus, the outside length of the machine in transport position is reduced. Further, this arrangement makes it possible to take up the slack of the cable constituting tie 27.

According to another characteristic, and as shown in dotted line in FIG. 2, back holding cable 19 is connected, at intermediate point 49, to auxiliary sling 50 attached to joint 9 of the two elements 6 and 8 of mast 5. Sling 50 also takes up the slack of back holding cable 19 when the machine is in its transport position.

In order to further reduce the space requirements in the transport position, coupling element 26 of the set of posts 22 is preferably made of two rigid elements 51 and 52 pivoted between themselves at 53 by one of their ends, and pivoted by their other ends, respectively, at tops 21 and 25. This enables the two rigid bars 23 and 24 of the unit of posts 22 to be folded against one another in the transport position.

Of course, the invention is not limited to the single embodiment of the handling and lifting machine which has been described above by way of example; on the contrary, it takes in all variants respecting the same principle, regardless of the construction details and regardless of the particular applications in the field of handling and lifting of loads. Thus, it would not be going outside the scope of the invention to modify the connecting rod system associated with one of the jacks. The relative position of the joints used for unfolding of the machine might be modified. A mast which is foldable into more than two elements may be provided. The jacks, or some of the jacks may be provided with equivalent operating means. Further, the design may be simplified such that the connecting rod pivoted on the foot of the jib head member would be replaced by a stationary extension of the foot of the jib head member.

I claim:

1. A foldable machine for handling and lifting loads, including a mast foldable between at least two elements, a jib pivoted at a top portion of the mast, equipped with at least one counterbrace for straightening and holding the mast in the raised working position and a unit for holding the jib consisting of a tie, at least one post and a back holding cable connected to the back part of a rotating frame comprising, in combination:

(a) a first double-acting jack connected at one end to a lower mast element and at another end to a common joint of a system of connecting rods, the system of connecting rods having ends which are pivoted respectively on the base of an upper mast element and on the top of the lower mast element;

(b) a jib head member pivoted at a pivot point on one end of the jib, carrying means for suspension of a load and comprising, beyond the pivot pin on the jib, a foot having a connection with the tie of the holding unit; and (c) a second double-acting jack connecting the jib to a joint located on the foot of the jib head member and acting as a lever support point for the jib head member, and wherein connection between the foot of the jib head member and the tie of the holding unit consists of a connecting rod pivoted at a pivot point on the foot of the jib head member and connected to the tie, and a third jack pivoted at a pivot point on the foot of the jib head member and resting on a joint carried by the connecting rod.

2. The handling and lifting machine according to claim 1, wherein the connecting rod comprises a longitudinal hole, through which a support pin of the third jack passes, the pin being movable between one end of the longitudinal hole in a working position, and another end of the longitudinal hole in a transport position.

3. The handling and lifting machine according to claim 1, wherein the upper mast element comprises, at a top end, a roller having a horizontal axis, the back holding cable passing around the roller.

4. The handling and lifting machine according to claim 3, wherein the tie of the holding unit consists of a cable.

5. The handling and lifting machine according to claim 4, wherein the at least one post comprises two rigid posts each having a top, the respective tops being connected together by a coupling element achieved by two rigid elements pivoted between themselves and also pivoted respectively at the two tops of the two posts.

6. The handling and lifting machine according to claim 5, wherein the back holding cable is connected, at an intermediate point, to an auxiliary sling attached to a joint of the two elements of the mast.

7. The handling and lifting machine according to claim 6, wherein the system of connecting rods associated with the first double-acting jack is made up of first and second connecting rods joined together at one of each of their ends around a common pin to the first double-acting jack, the first connecting rod being pivoted by its other end at base end of the upper mast element and the second connecting rod is pivoted by its other end at the top end of the lower mast element.

8. The handling and lifting machine according to claim 7, further comprising a self-propelled carrying frame, which is able to be self-propelled, and which is equipped with an orientation device for rotating the rotating frame.

* * * * *